United States Patent [19]

Kohashi

[11] Patent Number: 4,972,882

[45] Date of Patent: Nov. 27, 1990

[54] AUTOMATIC WEIGHT SORTING MACHINE

[75] Inventor: Toru Kohashi, Hyogo, Japan

[73] Assignee: Yamato Scale Company, Limited, Akaski, Japan

[21] Appl. No.: 333,551

[22] Filed: Apr. 4, 1989

[30] Foreign Application Priority Data

Apr. 26, 1988 [JP] Japan ..... 63-103757

[51] Int. Cl.[5] ..... B65B 1/46

[52] U.S. Cl. ..... 141/1; 141/83; 141/94; 141/135; 141/144; 177/55; 177/56; 177/25.19

[58] Field of Search ..... 141/1, 83, 94, 95, 144, 141/135; 177/3, 52, 53, 54, 55, 56, 25.12, 25.13, 25.19

[56] References Cited

U.S. PATENT DOCUMENTS

| | | | |
|---|---|---|---|
| 3,073,400 | 1/1963 | Bauder et al. | 177/25.12 X |
| 3,368,593 | 2/1968 | Mamas | 141/83 |
| 3,484,813 | 12/1969 | Davies | 177/50 |
| 4,513,796 | 4/1983 | Miller et al. | 141/83 |
| 4,582,102 | 4/1986 | Risser | 141/95 |
| 4,696,329 | 9/1987 | Izzi | 141/1 |

FOREIGN PATENT DOCUMENTS

| | | | |
|---|---|---|---|
| 3425082 | 1/1986 | Fed. Rep. of Germany | 141/83 |
| 0127121 | 5/1988 | Japan | 177/25.12 |
| 2096333 | 10/1982 | United Kingdom | 141/83 |

*Primary Examiner*—Ernest G. Cusick

*Attorney, Agent, or Firm*—Senniger, Powers, Leavitt & Roedel

[57] ABSTRACT

An automatic weight sorter used with a rotary container filling machine for sorting filled containers by weight. The filling machine has a rotary platform with a plurality of filling stations in which the containers, such as bottles, are supported for filling liquid product dispensed through a filling head at each filling station. The sorter is disposed at the exit end of the filling machine for successively weighing the filled bottles to sort them into predetermined classes of weight. The sorter is provided with an electronic device for storing measured weights for each filling station, calculating average weight for each station, counting the number of the sorted bottles in each class for each filling station, selectively displaying these data on a display screen and generating an alarm when the number of defective product exceeds a predetermined value.

15 Claims, 7 Drawing Sheets

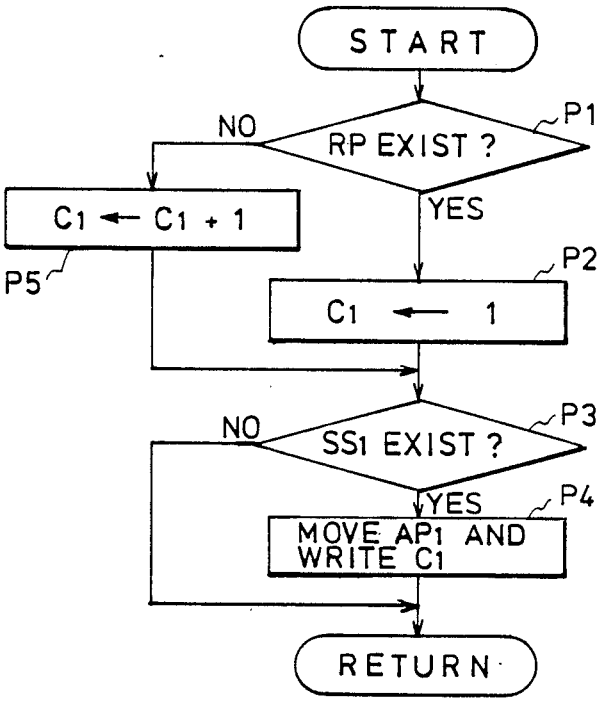
FIG. 5A
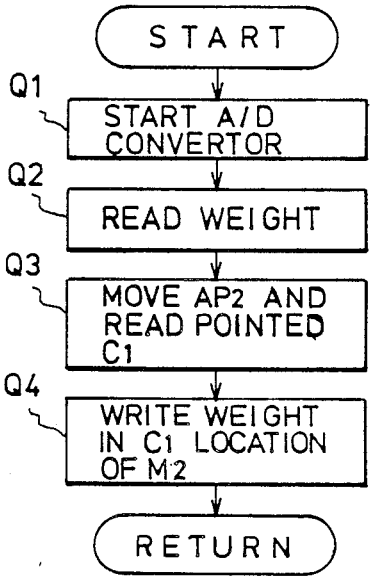
FIG. 5B
| HEAD NO. (C1) | | 1 | 2 | 3 | 4 | 5 | 6 | 7 | 8 | MEMORY REGION |
|---|---|---|---|---|---|---|---|---|---|---|
| MEASURED WEIGHT | | | | | | | | | | M2 |
| CUMULATIVE SUM WT. | | | | | | | | | | M3 |
| MEAN WT. | | | | | | | | | | M4 |
| WT. CLASS | LOW | | | | | | | | | M5 |
| | MEDIUM | | | | | | | | | M6 |
| | HIGH | | | | | | | | | M7 |
| REJECTS | | | | | | | | | | M8 |
FIG. 6

AUTOMATIC WEIGHT SORTING MACHINE

BACKGROUND OF THE INVENTION

This invention relates to an automatic weight sorting machine for sorting by weight a number of containers filled with product which are delivered successively from an automatic filling machine having a plurality of filling stations or heads.

U.S. Pat. No. 4,582,102 discloses a weight sorting machine for use with a rotary bottle filling machine which can sort products into predetermined classes of weight and calculate the average weight and the number of products in each class for displaying these data on a screen and alarming upon detection of defective data. In case of using such weight sorting machine in co-operation with the above-mentioned rotary filling machine, however, it does not store the measured weight, in correspondence to the respective filling heads. Therefore, even if an abnormal measured weight is found, there is no way to identify which filling head caused this condition. Accordingly, in such case, the operator had to repeat, troublesome and time-consuming trial and error operation of each filling head for finding the abnormal filling head for repair or readjustment.

SUMMARY OF THE INVENTION

Accordingly, an object of this invention is to provide an improved automatic weight sorting machine for use with a multi-head filling machine, which can store, calculate and display various data for each filling head, thereby enabling direct detection of defective heads for prompt repair or readjustment thereof.

This object can be attained by an improved automatic weight sorting machine according to this invention, which comprises means for sequentially weighing containers having product respectively filled by respective filling heads of a co-operating filling machine, means for identifying each container weighed by said weighing means corresponding to the filling head which filled said container, memory means corresponding to each filling head for responding to an identification signal from said identifying means to store the measured weight of the container filled by a corresponding filling head, calculating means corresponding to each filling head for responding to said identification signal from said identifying means to calculate a mean value of a predetermined number of measured weights of said containers filled by a corresponding filling head, means for classifying the measured weights from said weighing means into predetermined two or more classes, first counting means corresponding to each filling head for responding to the result of classification of said classifying means and the identification signal from said identifying means to count the number of containers filled by a corresponding filling head and classified into each said class, second counting means corresponding to each filling head for responding to the result of classification and the identification signal from said identifying means to count the number of containers filled by a corresponding filling head and continuously classified into one of said classes previously specified as defective, and display means for displaying the stored values of said memory means, the mean values from said calculating means, the count of said first counting means and/or the count of said second counting means The above-mentioned automatic weight sorting machine may be preferably provided with display selecting means for selectively specifying items of data to be displayed and/or alarm means for generating an alarm signal when the count of the second counting means exceeds a predetermined value and/or when the mean value from the calculating means exceeds a predetermined value.

If some means for conveying the filled containers, such as a belt conveyor, is disposed between the filling machine and the weighing means, the identifying means may include means for generating a second identification signal indicative of the filling head which filled each container conveyed by the conveying means, arrival detecting means responsive to arrival of each filled container at the weighing means for generating an arrival detection signal, second memory means having a plurality of successive memory locations, writing means for sequentially writing said second identification signals in the respective memory locations of said second memory means, and reading means for sequentially reading the content of said memory locations of said second memory means in response to said arrival detection signals.

These and other objects and features of this invention will be described in more detail below with reference to the accompanying drawings.

BRIEF DESCRIPTION OF THE DRAWINGS

FIGS. 5A and 5B are flow charts representing two sub-routines of an operational program of the control unit of the embodiment of FIG. 1;

FIG. 6 is a tabular representation of the internal structures of other memory means included in the control unit of the embodiment of FIG. 1;

DETAILED DESCRIPTION OF THE EMBODIMENTS

Figure 1:
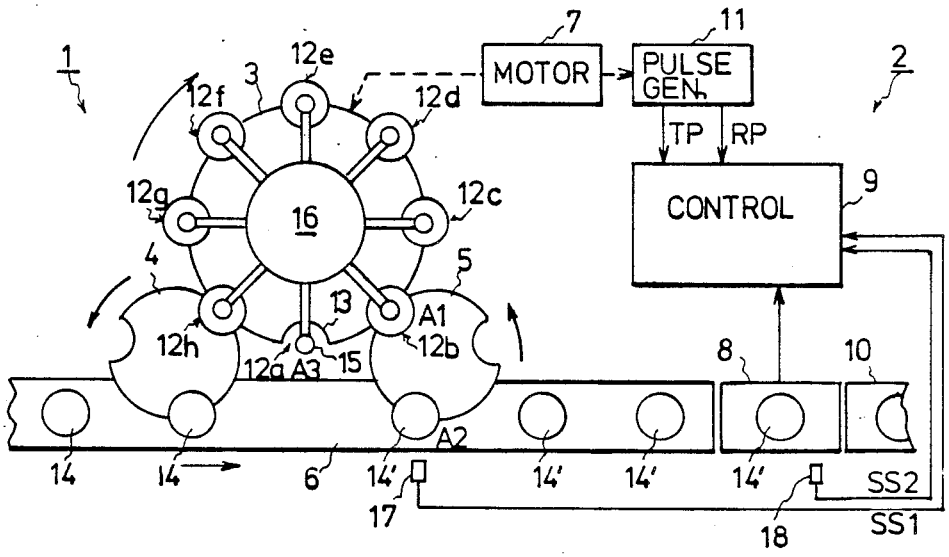
FIG. 1 is a schematic plan view, partly in block form, of an embodiment of the inventive automatic weight sorting machine co-operating with a conventional multi-head rotary bottle filling machine.

Referring first to FIG. 1, there is shown an eight-head rotary bottle filling machine 1 and a co-operating automatic weight sorting machine 2 according to this invention. The filling machine 1 includes a rotary filling unit 3, a loading unit 4, an unloading unit 5 and a belt conveyor 6, which are synchronously driven by a motor 7. The weight sorting machine 2 includes a weighing unit 8, a control unit 9, a take-out conveyor 10 and a pulse generator 11 also driven by the motor 7. The filling unit 3 includes eight filling stations or heads 12*a*, 12*b*, 12*c*, 12*d*, 12*e*, 12*f*, 12*g* and 12*h*, each having a bottle catching unit 13 for catching a bottle 14 to be filled and revolving it around a central axis and a filling nozzle 15 for injecting liquid product such as drink fed from a common source 16 into the bottle 14 during its revolution. The loading unit 4 is adapted to successively catch empty bottles 14 carried in line by the belt conveyor 6 and to deliver them one by one to the catching units 13, The unloading unit 5 is adapted to receive filled bottles 14' from the catching units 13 and to return them onto the belt conveyor 6. In this embodiment, the unloading unit 5 is designed so as to receive a filled bottle 14 from a specific catching unit at position A1 and return it onto the belt conveyer 6 at position A2 at the same time as the catching unit 4 arrives at position A3 after a 45 degree revolution. The end of belt conveyer 6 is adjacent to the weighing unit 8 which may be a conventional conveyer-type electronic weigher. Conveyor 6 delivers The filled bottles 14' onto the weighing unit 8. The weighing unit 8 weighs each filled bottle 14 and provides a corresponding weight indicative signal to the control unit 9. The take-out conveyer 10 receives the weighed bottles 14' from the weighing unit 8 to deliver them to a further process such as classification or sorting. The pulse generator 11, which may be of a rotary slit type, provides a timing pulse TP and an origin recognition pulse RP to the control unit 9 as described in detail later. A photoelectric sensor 17 is disposed for detecting each filled bottle on the conveyer 6 at position A2 to provide a first sense signal SS1 to the control unit 9 and another photoelectric sensor 18 is disposed for detecting the filled bottle 14' just after it is weighed by the weighing unit 8 to provide a second sense signal SS2 also to the control unit 9

Figure 2:
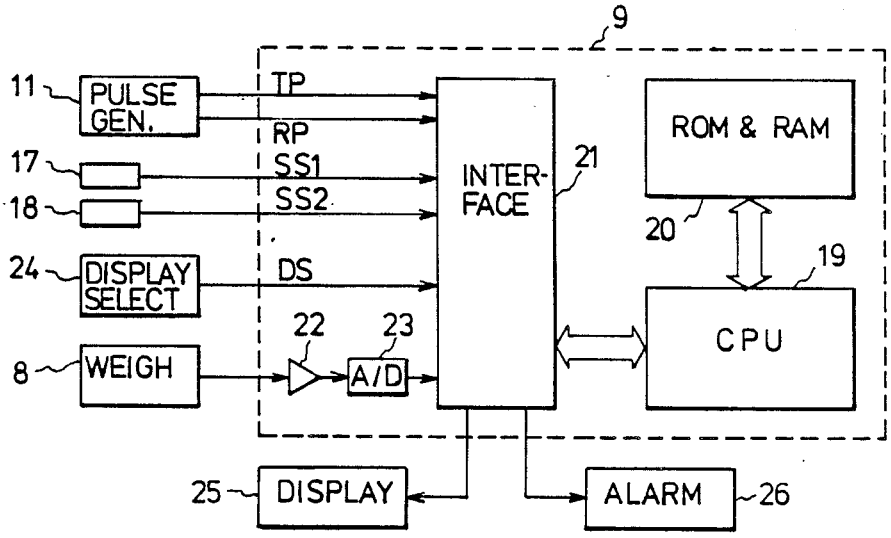
FIG. 2 is a block diagram of the weight sorting machine of FIG. 1.

As shown in FIG. 2, the control unit 9 includes a central processing unit (CPU) 19 which may be a microcomputer associated with a memory device 20. The CPU 19 receives the above-mentioned pulse signals TP and RP and sense signals SS1 and SS2 through an interface device 21. The CPU 19 also receives the weight signal from the weighing unit 8 through an amplifier 22, an analog-to-digital (A/D) convertor 23 and the interface device 21. As suggested in the preface, the CPU 19 of this inventive device can effect some improved operations such as (1) classifying measured weights of the bottles by each filling head and storing them in a random access memory (RAM) in the memory device 20, (2) calculating a mean value of the stored weights by each filling head, (3) sorting the measured weights corresponding to each filling head into predetermined classes and counting the number of bottles in each class, and (4) counting the number of bottles sorted continuously into a predetermined defective class. These data are temporarily stored in the RAM and selectively displayed by a display unit 25 in accordance with a display signal applied from a display selecting unit 24 such as a selector switch or keyboard unit An alarm device 26 may be provided for generating an alarm signal when the number of defective bottles exceeds a predetermined value.

Figure 3:
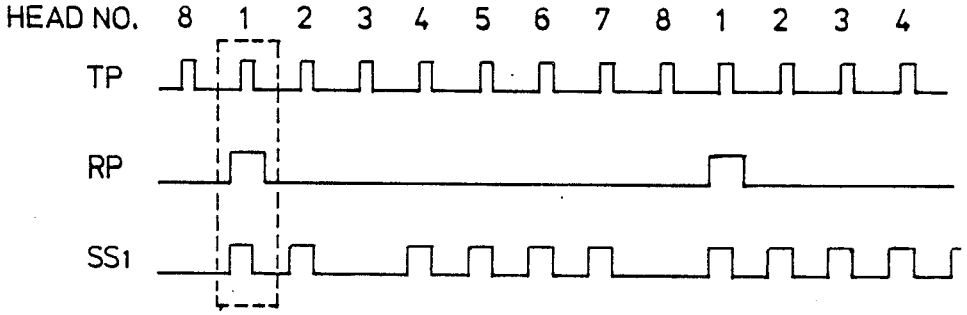
FIG. 3 is a waveform diagram representing a timing relationship of various signals used in the embodiment of FIG. 1.

In order to execute the above-mentioned operations, the device of this invention has means for identifying the filling head which filled a specific bottle which is now weighed by the weighing unit 8. For the purpose of description, reference numbers 1, 2, . . . 8 correspond to the filling heads 12*a*, 12*b*, . . . 12*h*. The pulse generator 11 is adapted to successively generate eight timing pulses TP every revolution of the filling unit 3 and an origin recognition pulse RP every time the first filling head 12*a* comes to the reference position A3 of FIG. 1. The memory device 20 includes a counter region and the TP pulses are counted by a C1-counter in this region. The C1-counter is adapted to reset its count C1 to "one" in response to each RP pulse. Accordingly, the count C1 represents the reference number of the filling head which is in position A3 and, therefore, which filled the bottle 14' which is now at position A2, as shown in FIG. 3 This count is successively stored in a memory region M1 provided in the RAM of the memory device 20 as described below.

Figure 4:
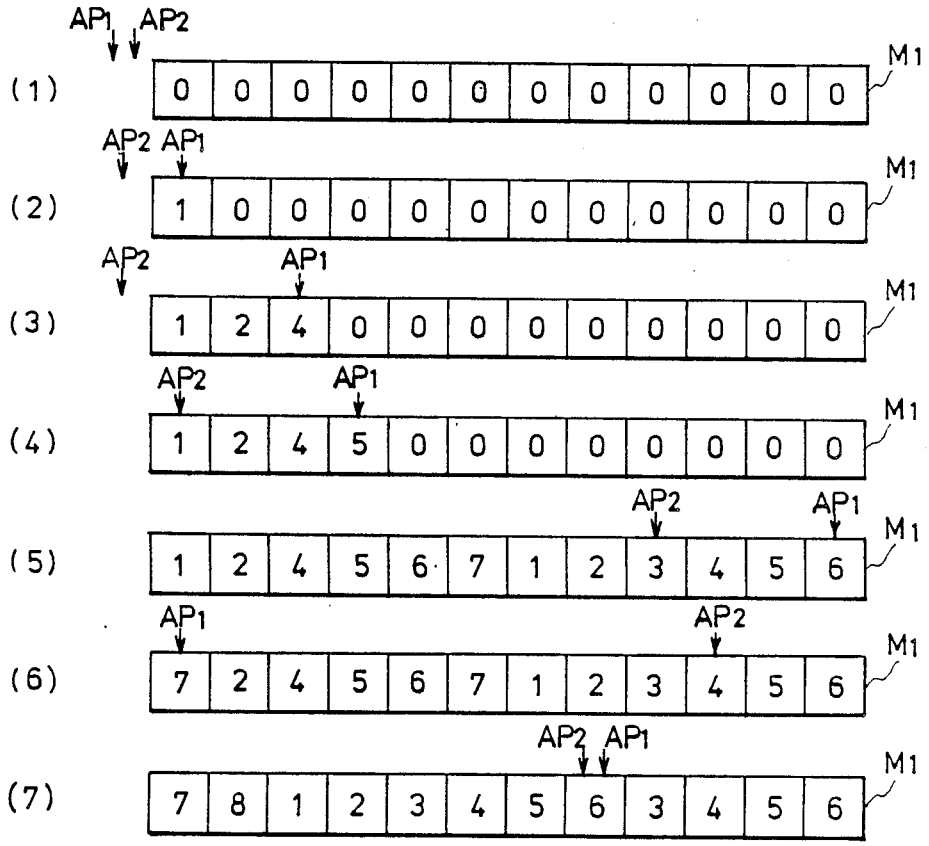
FIG. 4 is a set of diagrams illustrative of an exemplary operation of the second memory means included in a control unit of the embodiment of FIG. 1.

As shown in FIG. 4, the memory region M1 includes a plurality of memory locations arranged in line and has two address pointers AP1 and AP2 moving in response to the above-mentioned sense signals SS1 and SS2 to point the memory location to be written in and read out, respectively. A storage control operation of the memory region M1 is executed in accordance with programs as shown in the sub-routines given of FIGS. 5A and 5B. The sub-routine of FIG. 5A is executed every time the timing pulse TP is generated and the sub-routine of FIG. 5B is executed every time the second sense signal SS2 is generated, by interrupting a main routine which is previously stored in a read-only memory (ROM) of the memory device 20 and will be described later.

Assume now that the sub-routine of FIG. 5A starts in response to a timing pulse TP generated at the time point as shown in FIG. 1. The bottle 14' filled by the filling head 12*a* is unloaded onto the conveyer 6 at position A2 and the origin recognition pulse RP and the first sense signal SS1 are generated simultaneously as shown in a dashed block in FIG. 3. The memory locations of the memory region M1 are all zero as shown in FIG. 4(1). Both address pointers AP1 and AP2 are out of the first memory location at the left end of the memory region M1 as shown in FIG. 44). As shown in FIG. 5A, it is first inquired whether the origin recognition pulse RP exists or not (step Pl). As the answer is YES, the count of C1-counter is reset to "one" (step P2) and it is inquired whether the sense signal SS1 exists or not (step P3). As the answer is also YES, the first address pointer AP1 is moved to the first memory location in the memory region M1 and the current C1-count "one" is written in this location as shown in FIG. 4(2). Then the program returns to the main routine. When the filling unit 3 rotates 45 degrees and the bottle filled by the second filling head 12*b* is sensed at position A2, another timing pulse TP is generated to interrupt the main routine. In this case, however, no pulse RP is generated and, therefore, the C1-count is increased by one (step P5). Since the sense signal SS1 exists, the first address pointer API is moved to the next memory location of M1 region. The C1-count, in this case "two", is written into this memory location (step P4).

In the same manner, the memory location of M1-region moves rightwards one by one with the address pointer AP1 and the count of C1-counter is increased also one by one and written sequentially in the pointed location. However, when any bottle drops out from the filling head and, consequently, from location A2 by some accident, no sense signal SS1 occurs and the step P4 is omitted so that no count is written in this memory region though the C1-count is increased by one in step P5. This results in a dropout of the count corresponding to the number of accidental filling head from the sequential memory array. FIG. 4(3) shows a memory array when the first bottle filled by the filling head 12*a* gets on the weighing unit 8 and the fourth bottle is sensed by the first sensor 17, while the third filling head 12*c* was accidentally vacant and no corresponding sense signal SS1 was given as shown in FIG. 3.

When the first bottle 14 passes the second sensor 18, a sense signal SS2 is provided to the control unit 9 to interrupt the main routine and start the sub-routine as shown in FIG. 5B. In this routine, the A/D convertor 23 is first actuated (step Q1) and its digital output indicative of the weight of the first bottle is read in CPU 19 (step Q2). Then, the second address pointer AP2 is moved to the first memory location and the content of this location, namely, "one" is read out (step Q3). This count is supplied to another memory region M2 in the RAM of the memory device, 20 together with the weight read in the CPU 19. The weight is stored in a memory location of the region M2 specified by this count (step Q4) as described below with reference to FIG. 6. Accordingly, the memory array of M1 region becomes as shown in FIG. 4(4) when the second bottle arrives at the weighing unit 8 and the fifth bottle is sensed by the first sensor 17. Similarly, thereafter, the second address pointer AP2 moves rightwards one by one and the pointed memory content is read out and combined with the current weight signal every time the filled bottle 14' is sensed by the second sensor 18. When a phantom bottle such as the lost third bottle passes the second sensor 18, no signal SS2 is given and the subroutine of FIG. 5B is not executed. Thus, it is readily understood that the count read out from the memory region M1 is indicative of the head number which correctly corresponds to the weight of the filled bottle.

Assuming that the eighth bottle is also lost following the third bottle but no further dropout occurs thereafter as shown in FIG. 3, the storage procedure in the memory region M1 progresses similarly to reset the count C1 to "one" in response to each RP pulse and both pointers AP1 and AP2 move rightwards until the first pointer AP1 finally reaches the rightmost location as shown in FIG. 4(5). In the next step, the pointer AP1 returns to the leftmost or first location and the content of this location, namely "one" at this time, is substituted with the current C1-count, namely "seven", as shown in FIG. 4(6). Similarly, the second pointer AP2 also returns to the first location when it reaches the rightmost location. When the bottle loading operation is interrupted, for example, at the sixth filling head, the first pointer AP1 will no longer move after the last bottle filled by this head is sensed by the first sensor 17 though the second pointer AP2 continues its movement, Accordingly, the second pointer AP2 will finally reach the location of the first pointer API, which stores "six" in this case, as shown in FIG. 4(7) and no further change will occur in the memory region Ml.

Although the memory region M1 of FIG. 4 has twelve memory locations, it is understood that the number of such locations can be reduced to "four" in this example, since the number of memory locations existing between both pointers AP1 and AP2 is always "four" or less and no more location is needed for the above-mentioned operation. This allowable smallest number is equal to the number of bottles which can exist between both sensors 17 and 18 in FIG. 1.

Figure 7:
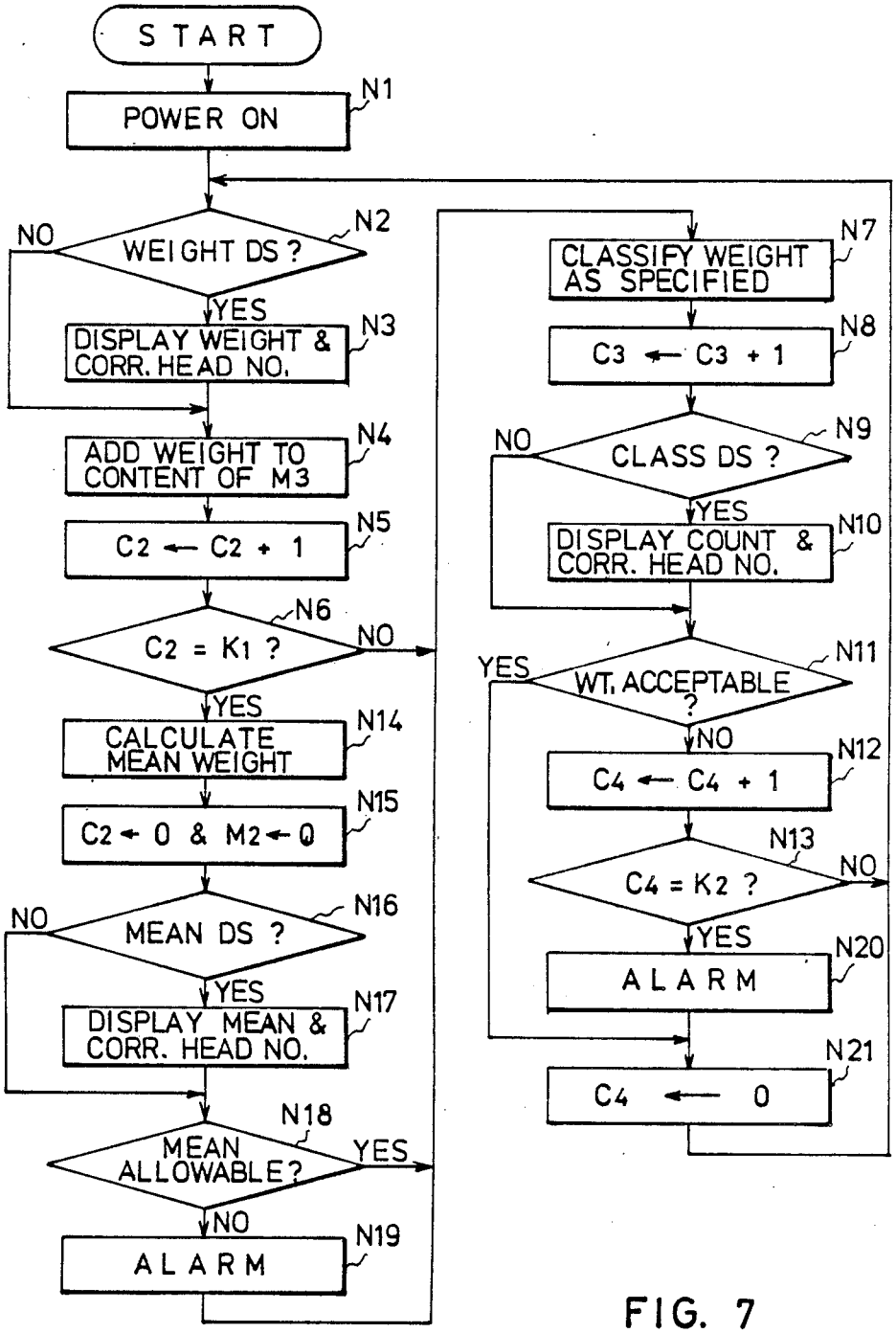
FIG. 7 is a flow chart representing a main routine of the operational program of the control unit of the embodiment of FIG. 1.

In addition to the memory region Ml, the memory device 20 includes seven memory regions M2 to M8, each having eight memory locations corresponding to respective filling heads 12*a* to 12*h*, as shown tabularly in FIG. 6. In the drawing, head numbers 1 to 8 correspond to C1-counts read out from the above-mentioned memory region M1 in step Q3. The region M2 is adapted to store the weight signal from the weighing unit 8 in its corresponding memory location in step Q4 as described above. The third region M3 is adapted to store a cumulative sum of the measured weights and the fourth region M4 is adapted to store a mean value thereof, by each filling head. The fifth, sixth and seventh regions M5, M6 and M7 are adapted to store the number of bottle-s classified into three predetermined classes by weight. The last region M8 is adapted to store the number of bottles whose weights are judged as unacceptable under a predetermined condition. These stored data can be selectively displayed by the display unit 25 in response to a display signal DS from the display selecting unit 24. Such storage and display operations are executed by CPU 19 in accordance with the main routine as shown in FIG. 7.

During execution of the main routine, three additional counters C2, C3 and C4 (not shown) included in CPU 19 are used as described below. It is assumed that these counters are initially all reset to "zero". In FIG. 7, the operator first puts on the power switch to start the weight sorting machine 2 and then operates the display selecting unit 24 to specify the items of data stored in the memory regions of FIG. 6 and provide corresponding display signals DS (step N1). In the next step, it is inquired whether a weight display signal exist or not (step N2. If YES, the measured weight is read out from the memory region M2 and displayed with the corresponding filling head number (step N3). If not, no weight is displayed. Then, the measured weight read out from the memory region M2 is stored in a corresponding memory location of the memory region M3, (step N4). Thereafter, the counter C2 is to increased by "one" (step N5) and it is inquired whether this count has reached a value K1 or not (step N6). K1 is a predetermined value corresponding to the number of weights to be accumulated in the memory region M3 for calculating a mean value thereof. As the answer is NO in this case, this weight is classified into one of the predetermined classes such as "low", "medium" and "high" weights, as shown in FIG. 6 (step N7) and the counter C3 of the corresponding class is increased by to "one" (step N8). This count is stored in a corresponding memory location of the memory regions M5 to M7. In the next step, it is inquired whether any class display signal exists or not (step 9) and, if YES, the stored C3-count is displayed with the specified class and filling head number (step N10). If not, no display is effected. Then, the weight value is compared with a predetermined allowable range and it is inquired whether it is acceptable or not (step N11). If not (unacceptable), the counter C4 is incremented by "one" (step N12) and it is then inquired whether this count has reached a specific value K2 or not (step N13). K2 is a predetermined extreme number of unacceptable bottles or rejects which is to be alarmed If the answer is NO, the program returns to step N2.

During this repetition, the successive measured weights are accumulated in each memory location of the memory region M3 (step N4) and the number of these weights is counted by the counter C2 (step N5). When this count reaches the value K1 (step N6), the mean weight by each filling head is calculated by dividing the content of each location of M3 by K1 (step N14). The result is stored in a corresponding memory location of the memory region M4 (FIG. 6). In the next step, the counter C2 is reset to "zero" and the corresponding memory location of M2 is cleared (step N15). Then, it is inquired whether a mean display signal exists or not (step N16) and, if YES, the calculated mean weight is displayed with the corresponding filling head number (step N17). If not, this display is not effected. Thereafter, the mean weight is compared with a predetermined allowable range and it is inquired whether it is allowable or not (step N18). If allowable, the process continues to step N7 but, if not, an alarm signal is generated from the alarm device 26 (step N19).

When the count C4 reaches the value K2 (step N13) during the progress of operation, an alarm is generated (step N20) and the counter C4 is reset to "zero" (step N21). Resetting the count C4 to "zero" is also effected when the weight is acceptable (step N11). Therefore, it is understood that . the alarm is only given when K2-number of rejects have appeared sequentially without interruption.

Figure 8:
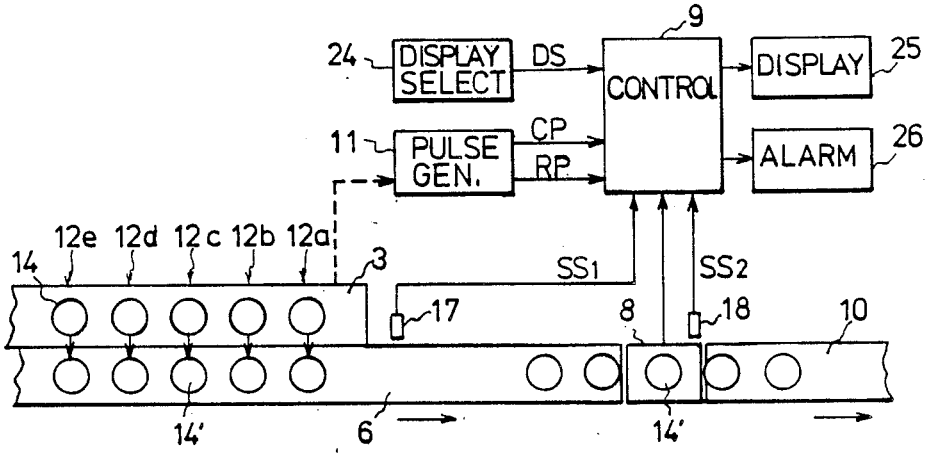
FIG. 8 is a schematic plan view, partly in block form, of a second embodiment of the inventive weight sorting machine co-operating with a conventional linear multi-batch type bottle filling machine.

In the embodiment of FIG. 8, the filling unit 3 of the bottle filling machine of FIG. 1 is constructed as of serial quintuple batch type instead of rotary type. This filling unit 3 includes five filling stations or heads 12*a*, 12*b*, 12*c*, 12*d* and 12*e* arranged serially and is adapted to catch five empty containers or bottles 14 which are loaded by a, suitable device such as belt conveyer, 6 and to fill the bottles 14 with product concurrently through five nozzles (not shown). Upon completion of this filling operation, the five filled bottles 14' are concurrently transferred in the direction of the arrow onto the belt conveyer 6 by a suitable unloading device (not shown) and conveyed rightwards to the weighing unit 8. The filled bottles 14 are sequentially detected by the photoelectric sensors 17 and 18 during movement and weighing, thereby producing first and second sense signals SS1 and SS2, respectively, as in the embodiment of FIG. 1

Figure 9:
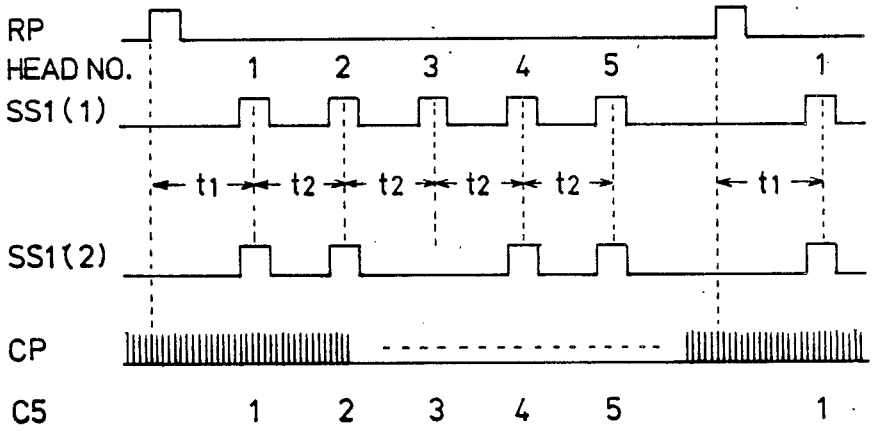
FIG. 9 is a waveform diagram representing a timing relationship of various signals used in the embodiment of FIG. 8.

The pulse generator 11 of this embodiment is adapted to generate independent clock pulses CP and also provide an origin recognition pulse RP every time the unloading device of the filling unit 3 is actuated, as shown in FIG. 9. As shown by SS1(1) of FIG. 9, the first sense signal SS1 corresponding to the bottle filled by the first filling head 12*a* is produced after a fixed time t1 from this pulse RP and, thereafter, four sense signals SS1 corresponding to the second to fifth filling heads are sequentially produced at time intervals t2 which correspond to the head interval. If a filled bottle drops out from a certain (e.g., the third) filling head, a corresponding SS1 pulse drops out as shown by SS1(2) of FIG. 9 The control unit 9 includes a C5-counter for counting the sense signals SS1 and a t-counter for counting the clock pulses CP to measure the time intervals t1 and t2. While the control unit 9 of this invention is similar to that of the embodiment of FIG. 1 in both structure and operation, it only differs in counting the clock pulses CP instead of the timing pulses TP. The operation will be described below with reference to FIG. 10.

Figure 10:
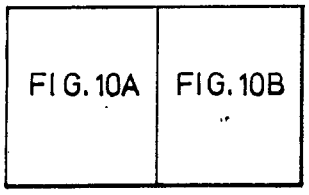
FIG. 10 composed as shown of FIGS. 10A and 10B is a flow chart representing a subroutine of an operational program of the embodiment of FIG. 8.
Figure 10A:
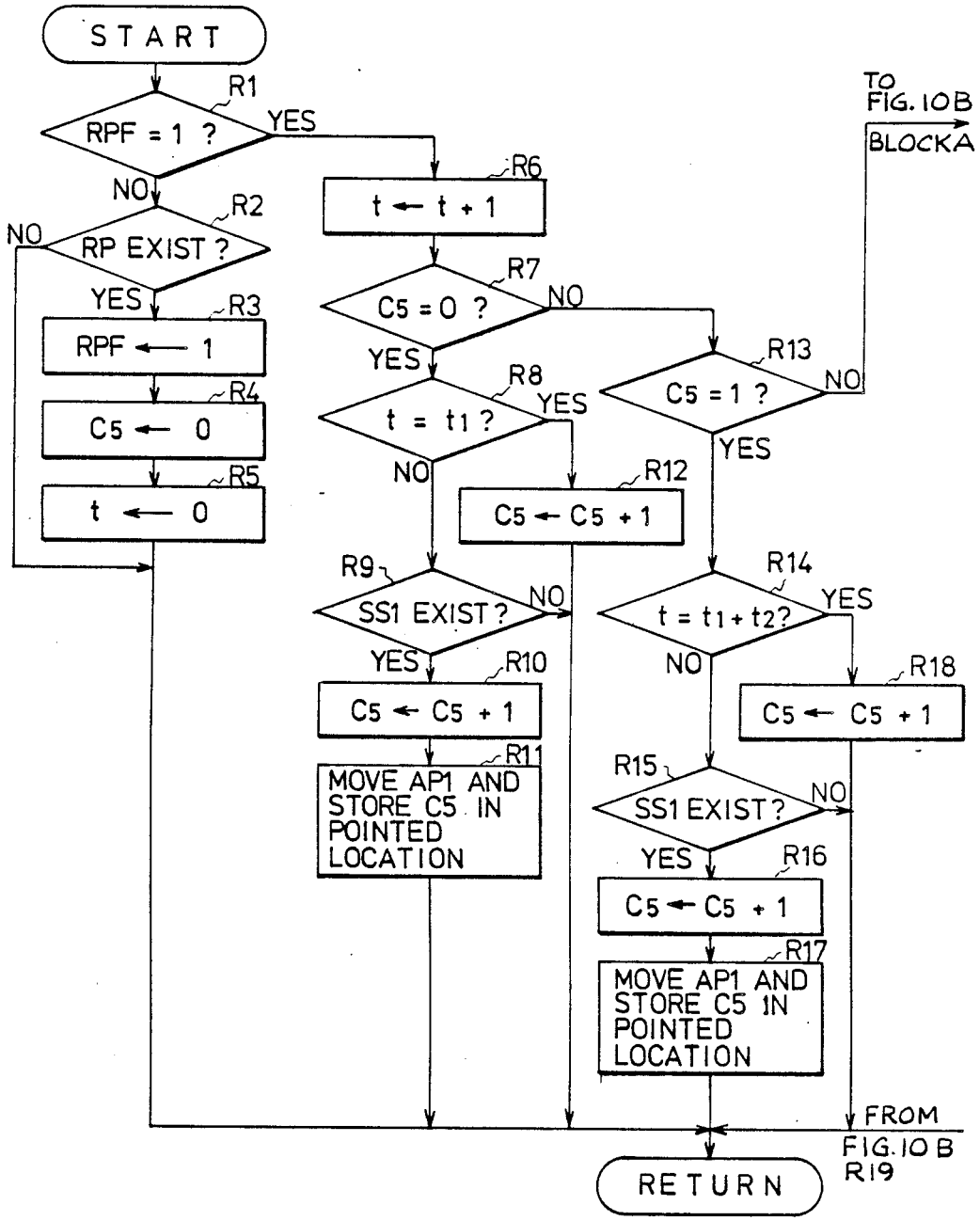

The sub-routine of FIG. 10 is executed by interrupting the main routine of FIG. 7 in response to each clock pulse CP. In order to avoid any counting error of the independently generated clock pulses, a recognition pulse flag RPF is used in this operation. This flag is defined as a binary state of a RPF register included in the CPU of the control unit 9 and assumed to be in a low level or "0" state at first. It is first inquired whether the RPF is in a high level or "1" state or not (step R1) and, as the answer is NO, it is then inquired whether the origin recognition pulse RP is input or not (step R2). If no RP input exists, the program returns to the main routine. However, if it exists, RPF is set to "1" (step R3), C5-counter is reset to "0" (step R4), t-counter is reset to "0" (step R5) and the program returns to the main routine.

As the answer of step R1 is, YES in the next cycle, the count of t-counter is increased by "1" (step R6) and it is inquired whether the count of C5-counter is "0" or not (step R7). As the answer is YES, it is inquired whether the t-count corresponds to the time t1 or not (step R8) As the answer is NO at first, it is inquired whether the sense signal SS1 is received or not (step R9). As the answer is NO until the first filled bottle 14' reaches the sensor 17, the program returns to the main routine and the same operation is repeated to increase the CP pulses every step R6 is encountered. In the meantime, the first filled bottle 14' is sensed by the sensor 17 and a signal SS1 is provided (step R9). The C5-count is then incremented by "1" (step R10) and, in the same manner as the embodiment of FIG. 1, the address pointer AP1 of the memory region M1 is moved to the first memory location and the C5-count "1" is written in this location (step R11). Then, the program returns to the main routine. If the first bottle has been lost, the t-count reaches the count corresponding to the predetermined time t1 before the SS1 signal (step R8). Accordingly, the C5-count is increased by "1" (step R12) and the program returns to the main routine. Thus, the lost bottle is counted but the count is not written in the memory region M1.

Figure 10B:
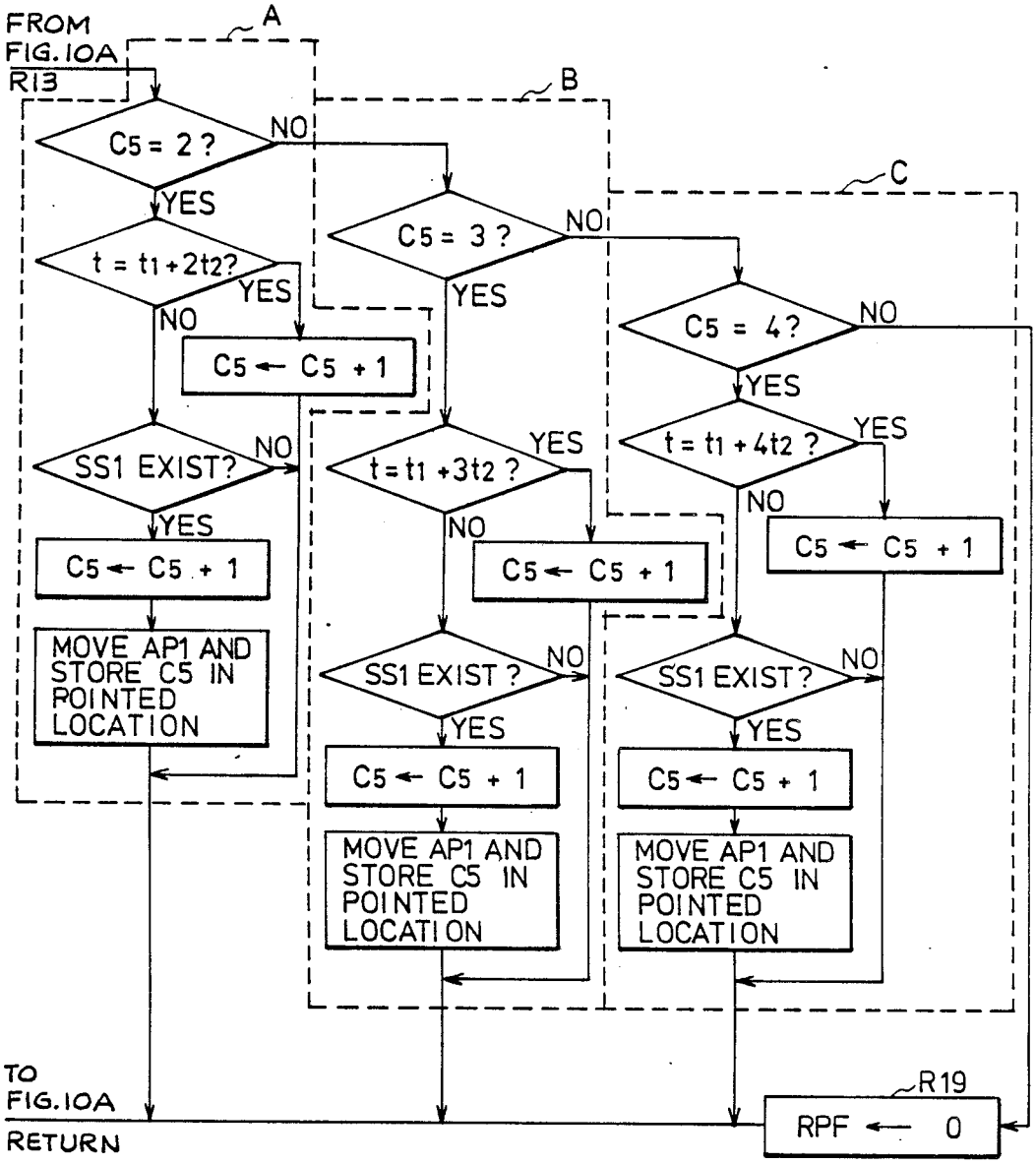

As the C5-count has become "1", the program progresses from step R7 to R13 in the next cycle and it is inquired whether C5-count-is "1" or not (step R13). As the answer is YES, it is further inquired whether the t-count corresponds to time t1+t2 or not (step R14) and the same operation is repeated until this answer becomes YES. When the second bottle is sensed by the sensor 17 in the meantime, steps R15 to R17 which are similar to steps R9 to R11 are executed to increase the C5-count to "2" and write it in the second memory location of the memory region M1. If the second bottle has been lost, the count becomes "2" (step R18) but is not written in M1 region. Thereafter, similar operations as shown in dashed blocks A, B and C in FIG. 10B are executed in the same manner in connection with the third to fifth bottles and corresponding filling head numbers 3, 4 and 5 are sequentially written in M1 region. Finally, the RPF flag is reset to "0" (step R19) and the program returns to the main routine.

The filling head numbers written in the memory region M1 are read out in accordance with the interrupt routine of FIG. 5B which is responsive to the second sense signal SS2, in the substantially same manner as the embodiment of FIG. 1. It is obvious that the measured weight value and the filling head number which are read out in response to the signal SS2 correctly correspond to each other as in the case of the embodiment of FIG. 1, since the writing and reading systems of the memory locations of M1 region are unchanged. It is, of course, possible to effect collection, calculation and display of various data and to alarm occurrence of abnormal condition as in the embodiment of FIG. 1, though no further description is made herein.

It should be understood that the above embodiments are given for illustrative purpose only but not for limitation, and various modifications and changes can be made within the scope of this invention as defined in the appended claims.

I claim:

1. A method of weighing a plurality of filled container delivered from a filling device including a plurality of filling means for filling the plurality of containers with product, the method comprising the steps of:

weighing the filled containers and providing corresponding weight values;

identifying the filling means which filled each of the containers;

storing the weight values of each of the filled containers and the identity of the filling means which filled it; and calculating a mean value of the stored weight values of containers filled by the same filling means and determining when any of the mean values is not within a predetermined range.

2. A method, as set forth in claim 1, wherein each filling means has a predetermined identification cone, and further comprising the steps of:

sequentially conveying said filled containers to said weighing means in the order of said identification codes of the corresponding filling means, sequentially sensing said containers prior to said weighing means and sequentially writing the identification codes of the filling means corresponding to said container in a plurality of serial memory locations of a memory means in a certain direction, and while weighing said container by said weighing means, sequentially reading the identification codes of the filling means corresponding to said container from said memory locations in the same direction.

3. A method, as set forth in claim 2, wherein said identification code writing locations are pointed by a first index in said writing step, said identification code reading locations are pointed by a second index in said reading step, said first pointer is shifted one by one in said direction along said memory locations in response to said container sensed, and said second index is shifted one by one in said direction along the memory locations in response to said container weighed.

4. A method, as set forth in claim 2, wherein said identification codes are sequential integral numbers 1, 2, 3, . . . n where n is the number of said filling means, timing pulses are generated in synchronism with the sense period of said containers, said timing pulses are counted to repeatedly provide counts from 1 to n, said counts are sequentially written in said memory locations in response to sensing of said containers, and said counts are made coincident with the identification codes of the filling means corresponding to said sensed containers.

5. An automatic weight sorting and filling machine including a plurality of filling means, each of the filling means of filling a container with product, the machine comprising:

weighing means for weighing the filled containers and providing corresponding weight values;

means for identifying the filling means which filled each of the containers including means for providing an identification code corresponding to each of the plurality of filling means;

memory means for storing the weight values of each of the filled containers and the identity of the filling means which filled it;

means for calculating a mean value, corresponding to each of the filling means, of the stored weight values of containers filled by the same filling means and for determining when any of the mean values is not within a predetermined range;

sorting means for classifying said weight values corresponding to each said identification code into a plurality of classes of weight;

first counting means for counting the number of said weight values classified by said sorting means into each said class of weight corresponding to each identification code;

second counting means for counting the number of said weight values continuously classified by said sorting means into a specific one of said classes of weight corresponding to each said identification code; and display means for selectively displaying the contents of said first memory means and output data of said arithmetic means and said first and second counting means in correspondence with said identification code.

6. The machine of claim 5, wherein said machine further comprises first alarm means for providing an alarm signal when the mean value from said arithmetic means does not fall within a predetermined range of weight.

7. The machine of claim 5, wherein said machine further comprises second alarm means for providing an alarm signal when the count of said second counting means exceeds a predetermined value.

8. The machine of claim 5, wherein said machine further comprises conveyor means for sequentially conveying said filled containers from said filling means to the weighing means of said machine, and wherein said identifying means comprises a first sensor for sequentially sensing the containers conveyed by said conveyor means at a position prior to said weighing means to provide first sense signals, a second sensor for sequentially sensing the containers conveyed to said weighing means to provide second sense signals, second memory means including a plurality of serial memory locations, writing means responsive to said first sense signals for sequentially writing the identification codes of the filling means corresponding to the sensed containers in the memory locations of said second memory means, and reading means responsive to said second sense signals for sequentially reading the identification codes of the filling means corresponding to the weighed containers from the memory locations of each second memory means and, at the same time, reading the weight values of said containers from said weighing means.

9. The machine of claim 8, wherein said second memory means includes first and second movable indexes for pointing said memory locations, said first index being adapted in response to each said first sense signal to move said memory locations sequentially one by one in one direction, said second index being adapted in response to each said second sense signal to move said memory locations sequentially one by one in the same direction, said writing means being adapted to write the identification code of the filling means which filled the container corresponding to said first sense signal in the memory location pointed by said first index, and said reading means being adapted to read the identification code written in the memory location pointed by said second index.

10. The machine of claim 8, wherein said identification codes are sequential integral numbers 1, 2, 3, . . . n where n is the number of said filling means, said writing means is provided with a pulse generator for generating timing pulses synchronized with the period of the sense signals of said sensors, a counter for counting said timing pulses to repeatedly provide counts 1 through n, and means responsive to the first sense signal corresponding to the identification code "1" for setting the count of said counter to "1", and wherein the count of said counter is used as the identification code of the filling means corresponding to the container currently sensed by said first sensor.

11. The machine of claim 10 wherein said pulse generator is interlocked with said filling means and said timing pulses are synchronized with the operation of said filling means.

12. The machine of claim 10, wherein said timing pulse generator comprises means for generating clock pulses and means for counting said clock pulses to generate said timing pulses.

13. The machine of claim 5 further comprising sorting means for classifying the weight values of containers filled by the same filling means into a plurality of classes of weight, first counting means for counting the number of weight values classified by the sorting means into each of the classes of weight, and second counting means for counting the number of weight values continuously classified by the sorting means into a specific one of the classes of weight, and display means for selectively displaying the contents of the memory means, the first counting means, or the second counting means.

14. The machine of claim 5 further comprising alarm means, connected to the calculating means, for providing an alarm signal to indicate that one or more of the mean values is not within the predetermined range.

15. The machine of claim 14 further comprising display means for displaying which one of the filling means has a mean value not within the predetermined range.

* * * * *